US005900895A

United States Patent [19]

Merrill

[11] Patent Number: 5,900,895

[45] Date of Patent: May 4, 1999

[54] METHOD FOR REFILLING AN INK SUPPLY FOR AN INK-JET PRINTER

[75] Inventor: David O. Merrill, Corvallis, Oreg.

[73] Assignee: Hewlett-Packard Company, Palo Alto, Calif.

[21] Appl. No.: 08/566,642

[22] Filed: Dec. 4, 1995

[51] Int. Cl.[6] ..... B41J 2/175

[52] U.S. Cl. ..... 347/86

[58] Field of Search ..... 347/85–87, 7

[56] References Cited

U.S. PATENT DOCUMENTS

| | | |
|---|---|---|
| 594,196 | 11/1897 | Cramer . |
| 714,264 | 11/1902 | Turajski . |
| 743,798 | 11/1903 | Allwardt . |
| 1,150,420 | 8/1915 | Davis . |
| 1,304,814 | 5/1919 | Schweinert . |
| 1,451,037 | 4/1923 | Blanchard . |
| 1,563,331 | 12/1925 | Bright . |
| 1,588,898 | 6/1926 | Martocello . |
| 1,638,488 | 8/1927 | Kellogg . |
| 1,759,872 | 5/1930 | Schwimmer . |
| 1,767,391 | 6/1930 | Muller . |
| 1,850,879 | 3/1932 | Hunt . |
| 1,859,018 | 5/1932 | Bedford . |
| 1,918,602 | 7/1933 | Joyce . |
| 2,011,639 | 8/1935 | Johannesson . |
| 2,024,682 | 12/1935 | Eisenman . |
| 2,086,569 | 7/1937 | Meyer . |
| 2,092,116 | 9/1937 | Hansen . |
| 2,258,919 | 10/1941 | Wallace . |
| 2,265,267 | 12/1941 | Cowles . |
| 2,288,565 | 6/1942 | Green . |
| 2,327,611 | 8/1943 | Scheiwer . |
| 2,370,182 | 2/1945 | Morrow . |
| 2,373,886 | 4/1945 | Geiger . |
| 2,412,685 | 4/1946 | Hoffman et al. . |
| 2,434,167 | 1/1948 | Knoblauch . |
| 2,459,477 | 1/1949 | Schuyver . |
| 2,492,271 | 12/1949 | Cox . |
| 2,557,807 | 6/1951 | Wagner . |
| 2,598,009 | 5/1952 | Peeps . |
| 2,612,389 | 9/1952 | MacGlashan . |
| 2,727,759 | 12/1955 | Elliott . |
| 2,789,838 | 4/1957 | Palm . |
| 2,842,382 | 7/1958 | Franck . |
| 2,888,173 | 5/1959 | Wolcott . |
| 2,915,325 | 12/1959 | Foster . |
| 2,919,935 | 1/1960 | Nyberg . |
| 2,925,103 | 2/1960 | Kerr . |
| 3,102,770 | 9/1963 | McKeegan . |
| 3,104,088 | 9/1963 | Cator . |
| 3,106,379 | 10/1963 | Sciuto . |
| 3,140,912 | 7/1964 | Davis . |
| 3,152,452 | 10/1964 | Bond, Jr. . |
| 3,157,314 | 11/1964 | Nadler . |
| 3,170,667 | 2/1965 | Szohatzky . |
| 3,223,117 | 12/1965 | Curie . |
| 3,230,964 | 1/1966 | Debrotnic . |
| 3,279,497 | 10/1966 | Norton . |
| 3,339,883 | 9/1967 | Drake . |
| 3,359,015 | 12/1967 | Zahuranec . |
| 3,430,824 | 3/1969 | Conners . |
| 3,490,473 | 1/1970 | Ehrens . |
| 3,493,146 | 2/1970 | Conners . |
| 3,537,477 | 11/1970 | Mahoff . |
| 3,613,959 | 10/1971 | Mason . |
| 3,614,940 | 10/1971 | Abrams et al. . |
| 3,640,309 | 2/1972 | Demler, Sr. . |
| 3,708,798 | 1/1973 | Hildenbrand . |
| 3,777,771 | 12/1973 | De Visscher . |
| 3,777,782 | 12/1973 | Shendure . |
| 3,787,882 | 1/1974 | Fillmore . |
| 3,805,276 | 4/1974 | Ishii . |
| 3,825,222 | 7/1974 | Petrova . |

(List continued on next page.)

*Primary Examiner*—Safet Metjahic
*Assistant Examiner*—Michael Dalakis
*Attorney, Agent, or Firm*—Kevin B. Sullivan

[57] ABSTRACT

The ink supply has an ink reservoir, a valve, a pressurizable chamber, and an outlet. The refilling is accomplished by directing ink from the outlet into the reservoir while the chamber is otherwise unpressurized so that the valve remains slightly open to permit the refill flow therethrough.

6 Claims, 10 Drawing Sheets

U.S. PATENT DOCUMENTS

| | | |
|---|---|---|
| 3,831,727 | 8/1974 | Kruspe . |
| 3,873,062 | 3/1975 | Johnson . |
| 3,896,853 | 7/1975 | Bernhard . |
| 3,924,654 | 12/1975 | Buller . |
| 3,950,761 | 4/1976 | Kashio . |
| 3,961,337 | 6/1976 | Jung . |
| 4,053,901 | 10/1977 | Skafvenstedt . |
| 4,053,902 | 10/1977 | Skafvenstedt . |
| 4,074,284 | 2/1978 | Dexter . |
| 4,079,384 | 3/1978 | Takano . |
| 4,084,165 | 4/1978 | Skafvenstedt . |
| 4,114,853 | 9/1978 | Medvick . |
| 4,119,034 | 10/1978 | Wax . |
| 4,122,457 | 10/1978 | Erickson . |
| 4,126,868 | 11/1978 | Kirner . |
| 4,131,899 | 12/1978 | Christou . |
| 4,142,653 | 3/1979 | Mascia . |
| 4,149,172 | 4/1979 | Heinzl . |
| 4,156,244 | 5/1979 | Erickson . |
| 4,178,595 | 12/1979 | Jinnai . |
| 4,183,031 | 1/1980 | Kyser . |
| 4,187,511 | 2/1980 | Robinson . |
| 4,204,215 | 5/1980 | Nakarai . |
| 4,234,885 | 11/1980 | Arway . |
| 4,253,103 | 2/1981 | Heinzl . |
| 4,263,602 | 4/1981 | Matsumoto . |
| 4,270,133 | 5/1981 | Shimazawa . |
| 4,287,523 | 9/1981 | Thomas . |
| 4,303,929 | 12/1981 | Blanck . |
| 4,320,407 | 3/1982 | Goldis . |
| 4,323,907 | 4/1982 | Italiano . |
| 4,324,239 | 4/1982 | Gordon . |
| 4,329,698 | 5/1982 | Smith . |
| 4,339,761 | 7/1982 | Matsumoto . |
| 4,340,896 | 7/1982 | Cruz-Uribe . |
| 4,342,041 | 7/1982 | Kasugayama . |
| 4,342,042 | 7/1982 | Cruz-Uribe . |
| 4,345,627 | 8/1982 | Cassia . |
| 4,357,617 | 11/1982 | Shimazawa . |
| 4,371,004 | 2/1983 | Sysolin . |
| 4,376,283 | 3/1983 | Bower . |
| 4,380,772 | 4/1983 | Italiano . |
| 4,383,263 | 5/1983 | Ozawa . |
| 4,394,669 | 7/1983 | Ozawa . |
| 4,403,229 | 9/1983 | Bartek . |
| 4,412,232 | 10/1983 | Weber . |
| 4,413,267 | 11/1983 | Hein . |
| 4,419,677 | 12/1983 | Kasugayama . |
| 4,421,296 | 12/1983 | Stephens . |
| 4,422,084 | 12/1983 | Saito . |
| 4,422,086 | 12/1983 | Miura . |
| 4,429,320 | 1/1984 | Hattori . |
| 4,433,341 | 2/1984 | Thomas . |
| 4,447,820 | 5/1984 | Terasawa . |
| 4,456,916 | 6/1984 | Kocot . |
| 4,460,904 | 7/1984 | Oszczakiewicz . |
| 4,462,037 | 7/1984 | Bangs . |
| 4,471,364 | 9/1984 | Kocot . |
| 4,475,116 | 10/1984 | Sicking . |
| 4,476,472 | 10/1984 | Aiba . |
| 4,496,959 | 1/1985 | Frerichs . |
| 4,496,960 | 1/1985 | Fischbeck . |
| 4,498,658 | 2/1985 | Mikiya . |
| 4,500,895 | 2/1985 | Buck . |
| 4,502,059 | 2/1985 | Blessington . |
| 4,506,862 | 3/1985 | Spinosa . |
| 4,509,659 | 4/1985 | Cloutier . |
| 4,511,906 | 4/1985 | Hara . |
| 4,520,369 | 5/1985 | Shackleton . |
| 4,527,170 | 7/1985 | Iwasaki . |
| 4,527,175 | 7/1985 | Kojima . |
| 4,536,777 | 8/1985 | Matsumoto . |
| 4,541,457 | 9/1985 | Blenkush . |
| 4,542,386 | 9/1985 | Delligatii . |
| 4,542,390 | 9/1985 | Bruning . |
| 4,555,719 | 11/1985 | Arway . |
| 4,558,326 | 12/1985 | Kimura . |
| 4,568,954 | 2/1986 | Rosback . |
| 4,575,738 | 3/1986 | Sheufelt . |
| 4,576,199 | 3/1986 | Svensson . |
| 4,586,058 | 4/1986 | Yamazaki . |
| 4,590,494 | 5/1986 | Ichihashi . |
| 4,591,875 | 5/1986 | McCann . |
| 4,593,294 | 6/1986 | Parisi . |
| 4,599,625 | 7/1986 | Terasawa . |
| 4,600,927 | 7/1986 | Sugitani . |
| 4,602,662 | 7/1986 | Eremity . |
| 4,604,633 | 8/1986 | Kimura . |
| 4,607,261 | 8/1986 | McCann . |
| 4,609,925 | 9/1986 | Nozu . |
| 4,610,202 | 9/1986 | Ebimura . |
| 4,623,905 | 11/1986 | Ichibashi . |
| 4,628,332 | 12/1986 | Matsumoto . |
| 4,628,333 | 12/1986 | Terasawa . |
| 4,630,072 | 12/1986 | Scardovi . |
| 4,630,758 | 12/1986 | Mutoh . |
| 4,636,814 | 1/1987 | Terasawa . |
| 4,639,738 | 1/1987 | Young . |
| 4,658,272 | 4/1987 | Toganoh . |
| 4,658,273 | 4/1987 | Yuki . |
| 4,672,993 | 6/1987 | Bilak . |
| 4,673,955 | 6/1987 | Ameyama . |
| 4,677,447 | 6/1987 | Nielsen . |
| 4,680,696 | 7/1987 | Ebinuma . |
| 4,683,905 | 8/1987 | Vigneau . |
| 4,684,962 | 8/1987 | Hirosawa . |
| 4,689,642 | 8/1987 | Sugitani . |
| 4,694,307 | 9/1987 | Toganoh . |
| 4,695,824 | 9/1987 | Tazaki . |
| 4,699,356 | 10/1987 | Hargrove . |
| 4,700,202 | 10/1987 | Kuranishi . |
| 4,700,205 | 10/1987 | Rich . |
| 4,700,744 | 10/1987 | Rutter . |
| 4,709,725 | 12/1987 | Morrison . |
| 4,714,937 | 12/1987 | Kaplinsky . |
| 4,719,475 | 1/1988 | Kiyohara . |
| 4,734,711 | 3/1988 | Piatt . |
| 4,736,774 | 4/1988 | Vonasek . |
| 4,737,801 | 4/1988 | Ichihashi . |
| 4,739,347 | 4/1988 | Ishikawa . |
| 4,739,847 | 4/1988 | Terasawa . |
| 4,757,331 | 7/1988 | Mizusawa . |
| 4,760,409 | 7/1988 | Kiyohara . |
| 4,765,657 | 8/1988 | Cruse . |
| 4,775,871 | 10/1988 | Abe . |
| 4,777,497 | 10/1988 | Nozu . |
| 4,785,314 | 11/1988 | Terasawa . |
| 4,811,035 | 3/1989 | Huliba . |
| 4,814,786 | 3/1989 | Hoisington . |
| 4,814,794 | 3/1989 | Sato . |
| 4,825,228 | 4/1989 | Gloeckler . |
| 4,826,052 | 5/1989 | Micallef . |
| 4,831,389 | 5/1989 | Chan . |
| 4,844,408 | 7/1989 | Beaston . |
| 4,849,773 | 7/1989 | Owatari . |
| 4,853,708 | 8/1989 | Walters . |
| 4,881,569 | 11/1989 | Fournier . |
| 4,888,602 | 12/1989 | Watanabe . |
| 4,896,171 | 1/1990 | Ito . |
| 4,898,209 | 2/1990 | Zbed . |
| 4,907,019 | 3/1990 | Stephens . |
| 4,910,529 | 3/1990 | Regnault . |

4,911,203 3/1990 Garms .
4,920,360 4/1990 Terasawa .
4,926,196 5/1990 Mizoguchi .
4,928,126 5/1990 Asai .
4,929,109 5/1990 Ikenaga .
4,931,044 6/1990 Beiter .
4,931,814 6/1990 Yoshimura .
4,934,655 6/1990 Blenkush .
4,935,751 6/1990 Hamlin .
4,940,995 7/1990 Hine .
4,940,997 7/1990 Hamlin et al. .
4,942,901 7/1990 Vescovini .
4,953,756 9/1990 Breault .
4,957,483 9/1990 Gonser .
4,958,754 9/1990 Dennis .
4,959,667 9/1990 Kaplinsky .
4,961,082 10/1990 Hoisington .
4,967,207 10/1990 Ruder .
4,968,998 11/1990 Allen .
4,970,533 11/1990 Saito .
4,973,993 11/1990 Allen .
4,977,413 12/1990 Yamanaka .
4,987,429 1/1991 Finley .
4,991,820 2/1991 Kohn .
4,992,802 2/1991 Dion .
4,995,940 2/1991 Hine .
4,999,652 3/1991 Chan .
5,002,254 3/1991 Belisaire .
5,008,688 4/1991 Ebinuma .
5,025,270 6/1991 Umezawa .
5,026,024 6/1991 Ito .
5,030,973 7/1991 Nonoyama .
5,043,746 8/1991 Abe .
5,053,787 10/1991 Terasawa .
5,070,347 12/1991 Yuki .
5,074,524 12/1991 Wade .
5,119,115 6/1992 Buat .
5,126,767 6/1992 Asai .
5,136,305 8/1992 Ims .
5,136,309 8/1992 Iida .
5,153,612 10/1992 Dunn .
5,155,502 10/1992 Kimura .
5,159,348 10/1992 Dietl .
5,182,581 1/1993 Kashimura .
5,187,498 2/1993 Burger .
5,189,438 2/1993 Hine .
5,199,470 4/1993 Goldman .
5,206,668 4/1993 Lo et al. .
5,215,231 6/1993 Paczonay .
5,216,452 6/1993 Suzuki .
5,220,345 6/1993 Hirosawa .
5,221,935 6/1993 Uzita .
5,221,936 6/1993 Saito .
5,245,915 9/1993 Ford .
5,255,827 10/1993 Breault .
5,270,739 12/1993 Kitani .
5,280,300 1/1994 Fong .
5,283,593 2/1994 Wehl .
5,289,212 2/1994 Carlotta .
5,293,913 3/1994 Preszler .
5,305,920 4/1994 Reiboldt .
5,306,125 4/1994 Weag .
5,307,091 4/1994 DeCoste, Jr. .
5,311,214 5/1994 Hirasawa .
5,320,326 6/1994 Ju .
5,328,055 7/1994 Battle .
5,329,294 7/1994 Ontawar .
5,331,339 7/1994 Takahashi .
5,337,925 8/1994 Ferrara, Jr. .
5,341,161 8/1994 Yamakawa .
5,343,226 8/1994 Niedermeyeyr .
5,348,192 9/1994 Sardynski .
5,351,073 9/1994 Kageyama .
5,359,353 10/1994 Hunt .
5,359,356 10/1994 Ecklund .
5,359,357 10/1994 Takaki .
5,365,260 11/1994 Kitani .
5,365,262 11/1994 Hattori .
5,368,070 11/1994 Bosley .
5,369,429 11/1994 Erickson .
5,372,306 12/1994 Yianilos .
5,381,172 1/1995 Ujita .
5,385,331 1/1995 Allread .
5,390,702 2/1995 Smith, III .
5,394,177 2/1995 McCann .
5,396,268 3/1995 Mader .
5,400,066 3/1995 Matsumoto .
5,400,573 3/1995 Crystal .
5,402,982 4/1995 Atkinson .
5,406,320 4/1995 Durst .
5,408,256 4/1995 Keen .
5,426,459 6/1995 Kaplinsky .
5,537,134 7/1996 Baldwin et al. ..... 347/85
5,574,489 11/1996 Cowger et al. ..... 347/86
5,583,545 12/1996 Pawloski, Jr. et al. ..... 347/7
5,621,445 4/1997 Fong et al. ..... 347/87
5,721,576 2/1998 Barinaga ..... 347/85
5,732,751 3/1998 Schmidt et al. ..... 347/7
5,734,401 3/1998 Clark et al. ..... 347/86
5,784,087 7/1998 Wallace et al. .

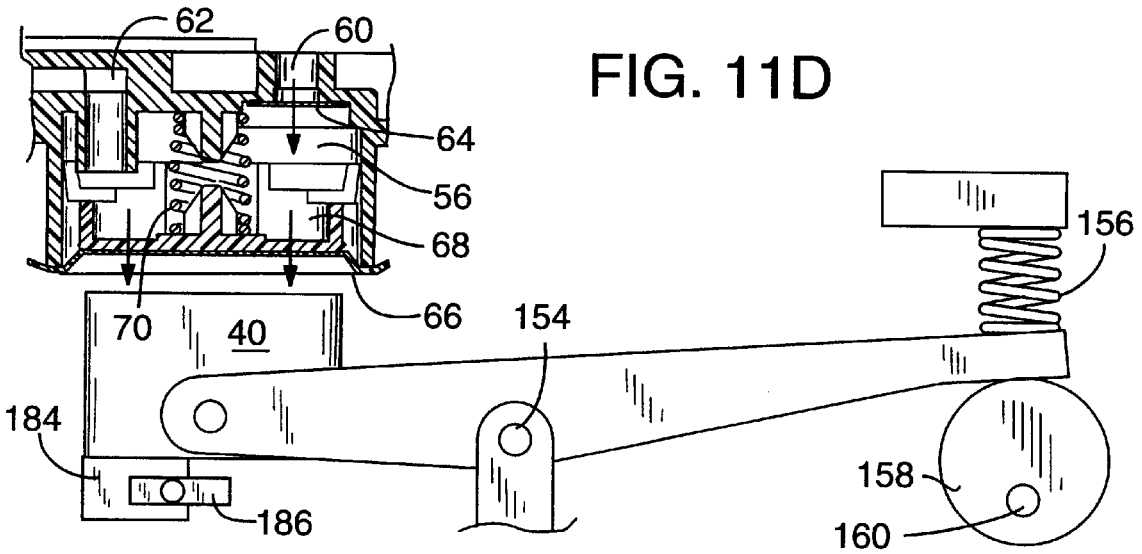
FIG. 11D
FIG. 13
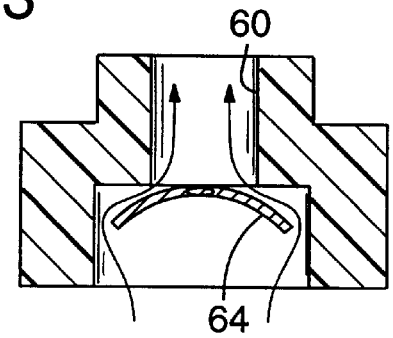
FIG. 14
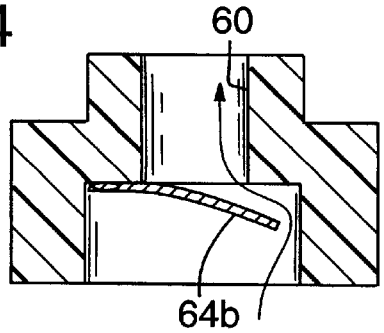

METHOD FOR REFILLING AN INK SUPPLY FOR AN INK-JET PRINTER

BACKGROUND AND SUMMARY OF THE INVENTION

The present invention relates to a method for refilling a reusable ink supply having a pressurized chamber.

A typical ink-jet printer has a pen mounted to a carriage that traverses a printing surface, such as a piece of paper. The pen carries a print head. As the print head passes over appropriate locations on the printing surface, a control system activates ink-jets on the print head to eject, or jet, ink drops onto the printing surface and form desired images and characters.

To work properly, such printers must have a reliable supply of ink for the print head. Many ink-jet printers use a disposable ink pen that can be mounted to the carriage. Such an ink pen typically includes, in addition to the print head, a reservoir containing a supply of ink. The ink pen also typically includes pressure regulating mechanisms to maintain the ink supply at an appropriate pressure for use by the print head. When the ink supply is exhausted, the ink pen is disposed of and a new ink pen is installed. This system provides an easy, user friendly way of providing an ink supply for an ink-jet printer.

However, in a printer using an ink pen, the entire ink pen, including the reservoir and ink supply, is moved with the print head. This requires a trade-off. If the ink pen has a large reservoir and ink supply, it is heavier and is more difficult to move quickly. This may limit the speed with which the printer can print—an important characteristic of a printer. On the other hand, if the ink pen has a small reservoir and ink supply, it will be depleted more quickly and require more frequent replacement.

The problems posed by size limitations of the ink reservoir have been heightened by the increasing popularity of color printers. In a color printer, it is usually necessary to supply more than one color of ink to the print head. Commonly, three or four different ink colors, each of which must be contained in a separate reservoir, are required. The combined volume of all of these reservoirs is limited in the same manner as the single reservoir of a typical one-color printer. Thus, each reservoir can be only a fraction of the size of a typical reservoir for a one-color printer.

Furthermore, when even one of the reservoirs is depleted, the ink pen may no longer be able to print as intended. Thus, the ink pen must typically be replaced and discarded, or at least removed for refilling, when the first of the reservoirs is exhausted. This further decreases the useful life of the ink pen.

As can be appreciated, the print head and pressure regulating mechanism of the ink pen contribute substantially to the cost of the ink pen. These mechanisms can also have a useful life expectancy far longer than the supply of ink in the reservoir. Thus, when the ink pen is discarded, the print head and pressure regulating mechanisms may have a great deal of usable life remaining. In addition, in multiple color ink pens, it is unlikely that all of the ink reservoirs will be depleted at the same time. Thus, the discarded ink pen will likely contain unused ink as well as a fully functional print head and pressure regulating mechanism. This results in increased cost to the user and a somewhat wasteful and inefficient use of resources.

To alleviate some of the shortcomings of disposable ink pens, some ink-jet printers have used ink supplies that are not mounted to the carriage. Such ink supplies, because they are stationary within the printer, are not subject to all of the size limitations of an ink supply that is moved with the carriage. Some printers with stationary ink supplies have a refillable ink reservoir built into the printer. Ink is supplied from the reservoir to the print head through a tube which trails from the print head. Alternatively, the print head can include a small ink reservoir that is periodically replenished by moving the print head to a filling station at the stationary, built-in reservoir. In either alternative, ink may be supplied from the reservoir to the print head by either a pump within the printer or by gravity flow.

However, such built-in reservoirs are frequently difficult and messy to refill. In addition, because they are never replaced, built-in ink reservoirs tend to collect particles and contaminants that can adversely affect printer performance.

In view of these problems, some printers use replaceable reservoirs. These reservoirs, like the built-in reservoirs are not located on the carriage and, thus, are not moved with the print head during printing. Replaceable reservoirs sometimes are plastic bags filled with ink. The bag is provided with a mechanism, such as a septum which can be punctured by a hollow needle, for coupling it to the printer so that ink may flow from the bag to the print head. Often, the bag is squeezed, or pressurized in some other manner, to cause the ink to flow from the reservoir. Should the bag burst or leak while under pressure, the consequences can be catastrophic for the printer.

One particular replaceable reservoir reliably supplies ink to the print head, yet is not complicated and can be manufactured simply and inexpensively. This reservoir is also easily recyclable.

The replaceable reservoir has an ink supply that has a main reservoir for holding a supply of ink. The main reservoir, which is typically maintained at about ambient pressure, is coupled to a variable volume chamber via a valve that allows the flow of ink from the reservoir to the chamber and limits the flow of ink from the chamber to the reservoir. The chamber is coupled to a fluid outlet which is normally closed to prevent the flow of ink. However, when the ink supply is installed in a printer, the fluid outlet opens to establish a fluid connection between the chamber and the pen.

The chamber can serve as part of a pump to supply ink from the reservoir to the pen. In particular, when the volume of the chamber is increased, ink is drawn from the reservoir through the valve and into the chamber. When the volume of the chamber is decreased, ink is forced from the chamber through the fluid outlet to supply the print head.

The reservoir includes flexible plastic walls supported by a rigid frame. The frame is carried by a chassis which also carries the variable volume chamber and the fluid outlet.

The present invention is particularly directed to a method for refilling an ink supply of the type described above. This allows the ink supply container to be reused.

The present method involves supplying refill ink into the ink supply container through the fluid outlet that otherwise, during normal operation, serves to direct the ink from the supply to the pen.

Other objects and aspects of the invention will become apparent to those skilled in the art from the detailed description of the invention which is presented by way of example and not as a limitation of the present invention.

BRIEF DESCRIPTION OF THE DRAWINGS

FIGS. 11A–D are cross-sectional views of the ink supply and docking bay showing the pump, actuator, and ink detector in various stages of operation, taken along line 11—11 of FIG. 10.

FIG. 13 is a cross sectional view, taken along line 13—13 of FIG. 12.

FIG. 14 is a cross sectional view, like FIG. 13, but of an alternative embodiment.

DESCRIPTION OF THE ILLUSTRATED EMBODIMENTS

Figure 1:
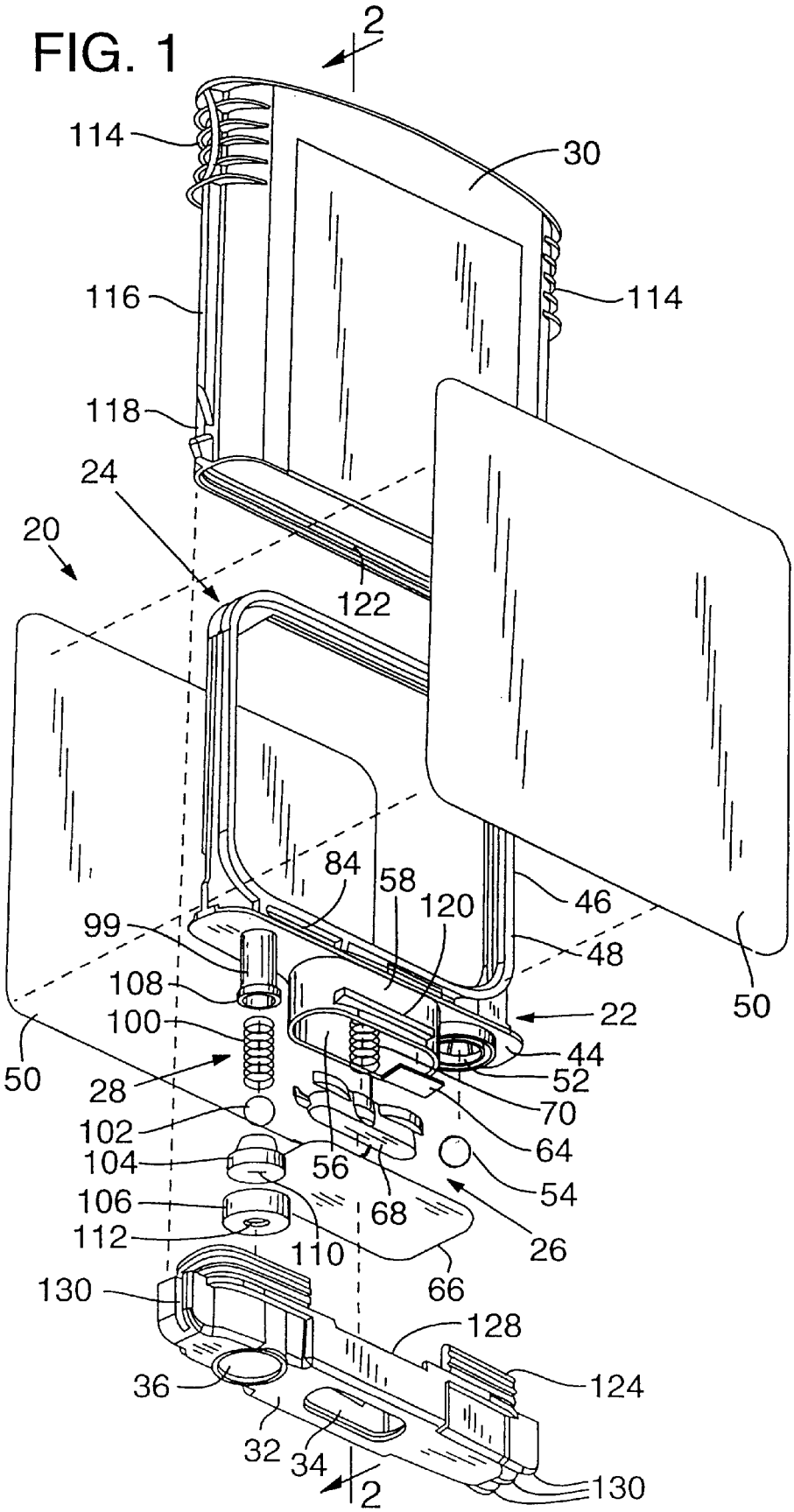
FIG. 1 is an exploded view of an ink supply that can be refilled using the method of the present invention.

An ink supply in accordance with a preferred embodiment of the present invention is illustrated in FIG. 1 as reference numeral 20. The ink supply 20 has a chassis 22 which carries an ink reservoir 24 for containing ink, a pump 26 and fluid outlet 28. The chassis 22 is enclosed within a hard protective shell 30 having a cap 32 affixed to its lower end. The cap 32 is provided with an aperture 34 to allow access to the pump 26 and an aperture 36 to allow access to the fluid outlet 28.

Figure 9:
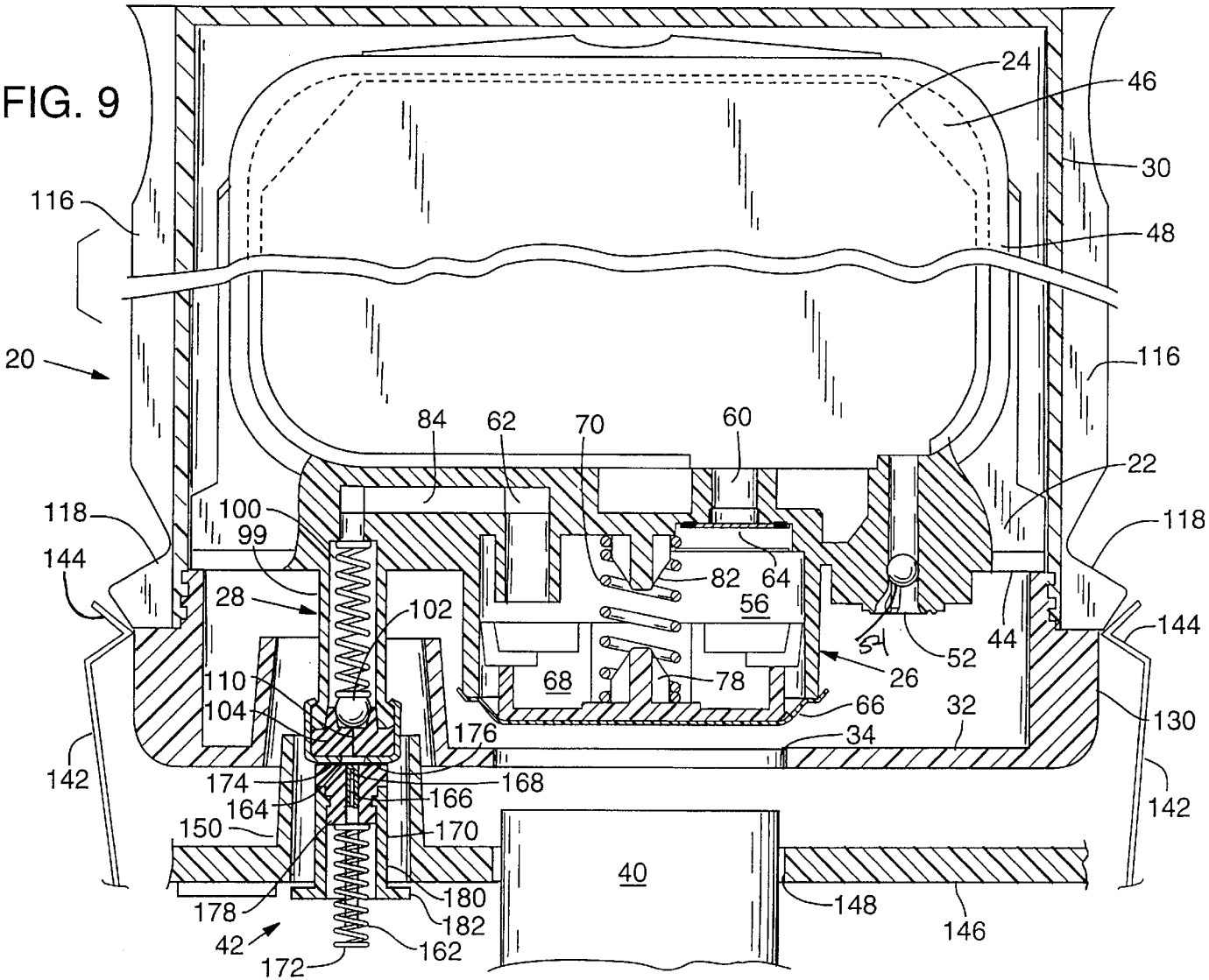
FIG. 9 is a cross sectional view of a part of the ink supply of FIG. 1 being inserted into the docking bay of an ink-jet printer.
Figure 10:
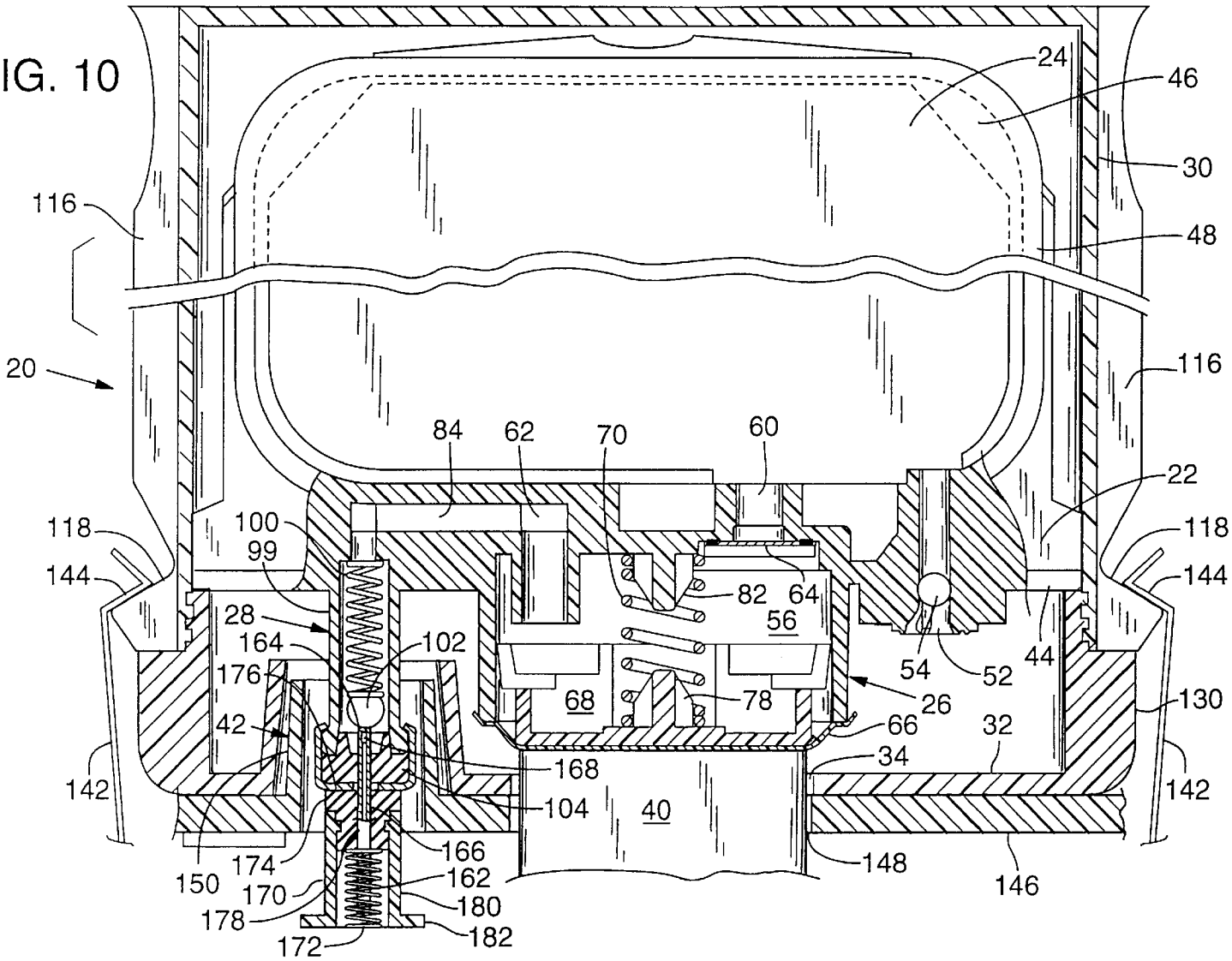
FIG. 10 is a cross sectional view showing the ink supply of FIG. 9 fully inserted into the docking bay.

In use, the ink supply 20 is inserted into the docking bay 38 of an ink-jet printer, as illustrated in FIGS. 9 and 10. Upon insertion of the ink supply 20, an actuator 40 within the docking bay 38 is brought into contact with the pump 26 through aperture 34. In addition, a fluid inlet 42 within the docking bay 38 is coupled to the fluid outlet 28 through aperture 36 to create a fluid path from the ink supply 20 to the pen. Operation of the actuator 40 causes the pump 26 to draw ink from the reservoir 24 and supply the ink through the fluid outlet 28 and the fluid inlet 42 to the pen.

Upon depletion of the ink from the reservoir 24, or for any other reason, the ink supply 20 can be easily removed from the docking bay 38. Upon removal, the fluid outlet 28 and the fluid inlet 42 close to help prevent any residual ink from leaking into the printer or onto the user. The ink supply 20 may then be refilled, discarded or stored for reinstallation at a later time. In this manner, the ink supply 20 provides a user of an ink-jet printer a simple, economical way to provide a reliable, and easily replaceable, supply of ink to an ink-jet printer.

Figure 2:
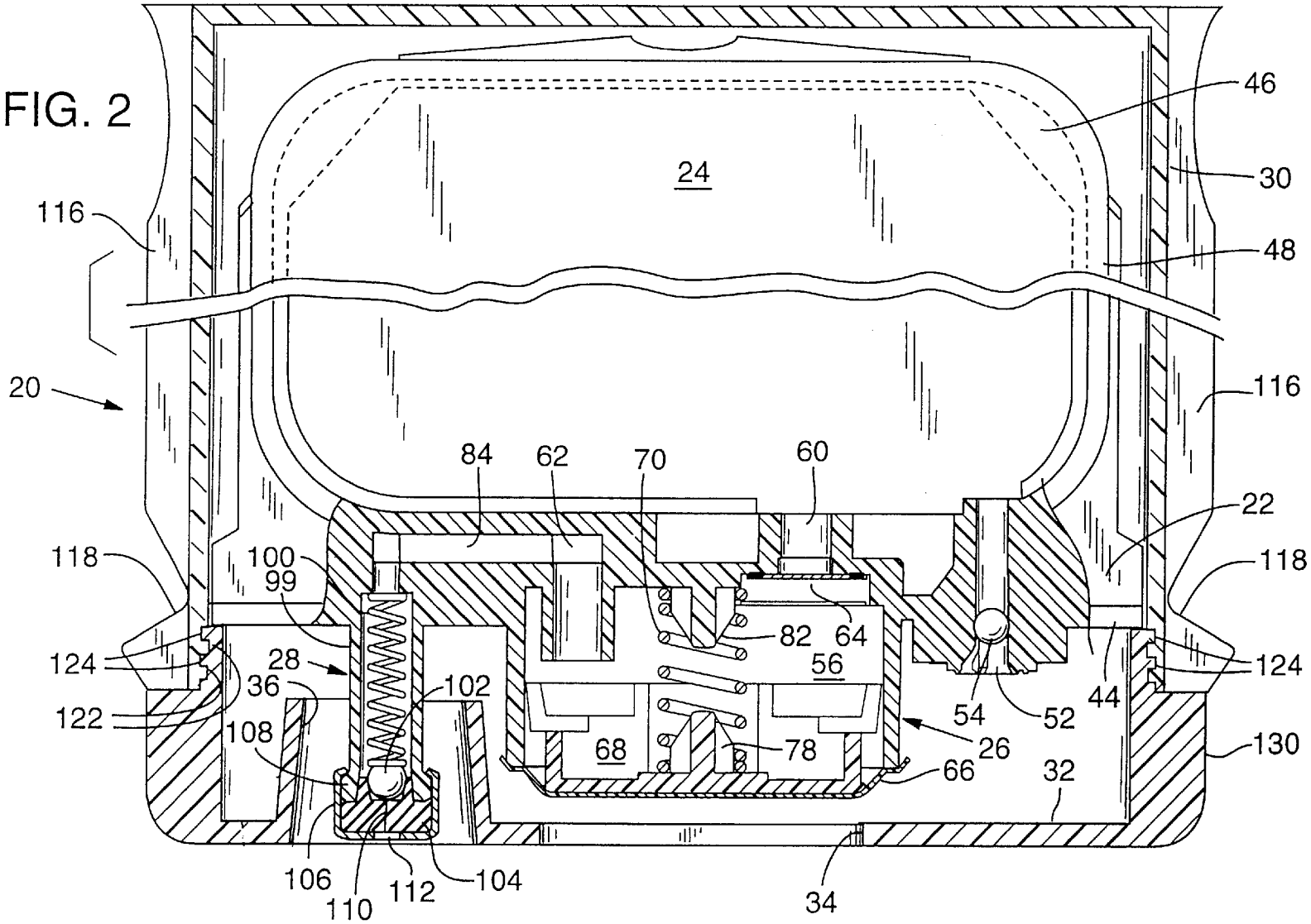
FIG. 2 is a cross sectional view of the ink supply of FIG. 1.
Figure 3:
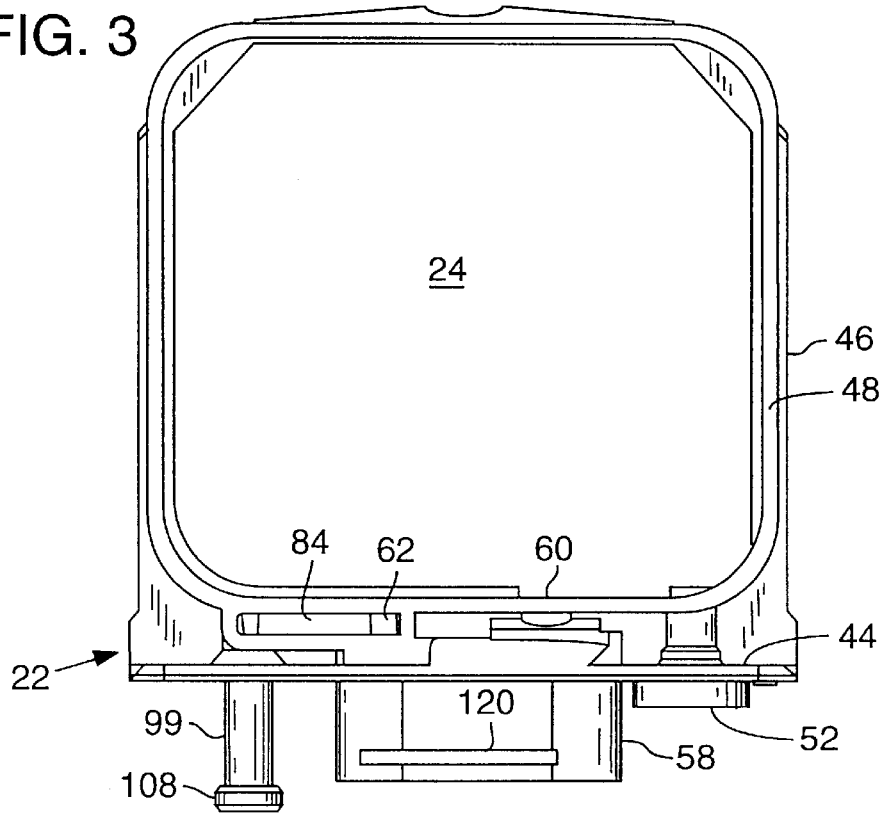
FIG. 3 is a side view of the chassis of the ink supply of FIG. 1.
Figure 4:
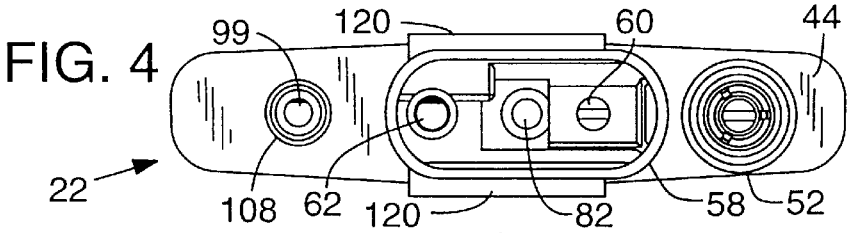
FIG. 4 is a bottom view of the chassis of FIG. 3.

As illustrated in FIGS. 1–3, the chassis 22 has a main body 44. Extending upward from the top of the chassis body 44 is a frame 46 which helps define and support the ink reservoir 24. In the illustrated embodiment, the frame 46 defines a generally square reservoir 24 having a thickness determined by the thickness of the frame 46 and having open sides. Each side of the frame 46 is provided with a face 48 to which a sheet of plastic 50 is attached to enclose the sides of the reservoir 24. The illustrated plastic sheet is flexible to allow the volume of the reservoir 24 to vary as ink is depleted from the reservoir 24. This helps to allow withdrawal and use of all of the ink within the reservoir 24 by reducing the amount of backpressure created as ink is depleted from the reservoir 24. The illustrated ink supply 20, is intended to contain about 30 cubic centimeters of ink when full. Accordingly, the general dimensions of the ink reservoir defined by the frame are about 57 mm high, about 60 mm wide, and about 5.25 mm thick. These dimensions may vary depending on the desired size of the ink supply and the dimensions of the printer in which the ink supply is to be used.

In the illustrated embodiment, the plastic sheets 50 are heat staked to the faces 48 of the frame in a manner well known to those in the art. The plastic sheets 50 are, in the illustrated embodiment, multi-ply sheets having a an outer layer of low density polyethylene, a layer of adhesive, a layer of metallized polyethylene terephthalate, a layer of adhesive, a second layer of metallized polyethylene terephthalate, a layer of adhesive, and an inner layer of low density polyethylene. The layers of low density polyethylene are about 0.0005 inches thick and the metallized polyethylene terephthalate is about 0.00048 inches thick. The low density polyethylene on the inner and outer sides of the plastic sheets can be easily heat staked to the frame while the double layer of metallized polyethylene terephthalate provides a robust barrier against vapor loss and leakage. Of course, in other embodiments, different materials, alternative methods of attaching the plastic sheets to the frame, or other types of reservoirs might be used.

The body 44 of the chassis 22, as seen in FIGS. 1–4, is provided with a fill port 52 to allow ink to be introduced into the reservoir 24. After filling the reservoir 24, a plug 54 is inserted into the fill port 52 to prevent the escape of ink through the fill port 52. In the illustrated embodiment, the plug 54 is a polypropylene ball that is press fit into the fill port 52.

A pump 26 is also carried on the body 44 of the chassis 22. The pump 26 serves to pump ink from the reservoir 24 and supply it to the printer via the fluid outlet 28. In the illustrated embodiment, seen in FIGS. 1 and 2, the pump 26 includes a pump chamber 56 that is integrally formed with the chassis 22. The pump chamber 56 is defined by a skirt-like wall 58 which extends downwardly from the body 44 of the chassis 22.

A pump inlet 60 is formed at the top of the chamber 56 to allow fluid communication between the chamber 56 and the ink reservoir 24. A pump outlet 62 through which ink may be expelled from the chamber 56 is also provided. A valve 64 is positioned within the pump inlet 60. The valve 64 allows the flow of ink from the ink reservoir 24 into the chamber 56 but limits the flow of ink from the chamber 56 back into the ink reservoir 24. In this way, when the chamber is depressurized, ink may be drawn from the ink reservoir 24, through the pump inlet and into the chamber and when the chamber is pressurized ink within the chamber may be expelled through the pump outlet. In the illustrated embodiment, the valve 64 is a flapper valve positioned at the bottom of the pump inlet 60. The flapper valve 64, illustrated in FIGS. 1 and 2, is a rectangular piece of flexible material. The valve 64 is positioned over the bottom of the pump inlet 60 and heat staked to the chassis 22 at the midpoints of its short sides (the heat staked areas are darkened in the Figures). When the pressure within the chamber 56 drops sufficiently below that in the reservoir 24, the unstaked sides of the valve 64 each flex downward to allow the flow of ink around the valve 64, through the pump inlet 60, and into the chamber 56. The valve 64 is configured to remain open as long as the chamber 56 is not pressurized. In alternative configurations, the flapper valve 64 could be heat staked on only one side so that the entire valve 64 would flex about the staked side, or on three sides so that only one side of the valve 64 would flex.

In the illustrated embodiment, the flapper valve 64 is made of a two ply material. The top ply is a layer of low density polyethylene 0.0015 inches thick. The bottom ply is a layer of polyethylene terephthalate (PET) 0.0005 inches thick. The illustrated flapper valve 64 is approximately 5.5 millimeters wide and 8.7 millimeters long. Of course, other materials or other sizes of valves may be used.

A flexible diaphragm 66 encloses the bottom of the chamber 56. The diaphragm 66 is slightly larger than the opening at the bottom of the chamber 56 and is sealed around the bottom edge of the wall 58. The excess material in the oversized diaphragm 66 allows the diaphragm 66 to flex up and down to vary the volume within the chamber 56. In the illustrated ink supply 20, displacement of the diaphragm 66 allows the volume of the chamber 56 to be varied by about 0.7 cubic centimeters. The fully expanded volume of the illustrated chamber 56 is between about 2.2 and 2.5 cubic centimeters.

The illustrated diaphragm 66 is made of the same multiply material as the plastic sheets 50. Of course, other suitable materials may also be used to form the diaphragm 66. The diaphragm 66 in the illustrated embodiment is heat staked, using conventional methods, to the bottom edge of the skirt-like wall 58. During the heat staking process, the low density polyethylene in the diaphragm 66 seals any folds or wrinkles in the diaphragm 66 to create a leak proof connection.

Figure 5:
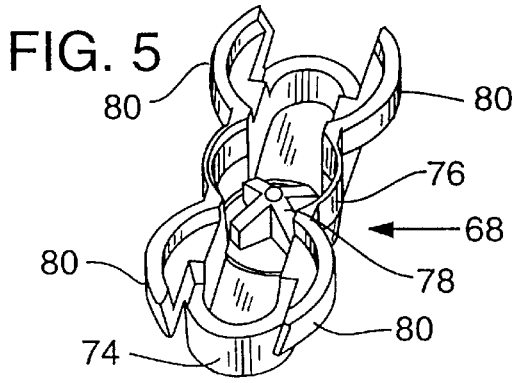
FIG. 5 is a top perspective view of the pressure plate of the ink supply of FIG. 1.
Figure 6:
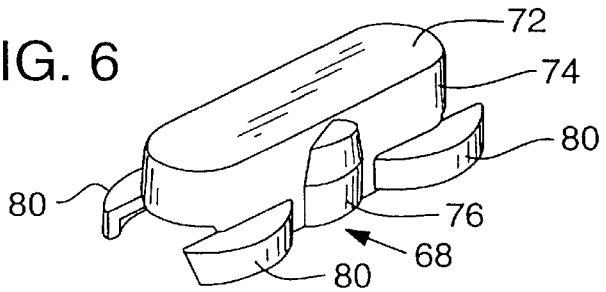
FIG. 6 is a bottom perspective view of the pressure plate of FIG. 5.

A pressure plate 68 and a spring 70 are positioned within the chamber 56. The pressure plate 68, illustrated in detail in FIGS. 5 and 6, has a smooth lower face 72 with a wall 74 extending upward about its perimeter. The central region 76 of the pressure plate 68 is shaped to receive the lower end of the spring 70 and is provided with a spring retaining spike 78. Four wings 80 extend laterally from an upper portion of the wall 74. The illustrated pressure plate 68 is molded of high density polyethylene.

The pressure plate 68 is positioned within the chamber 56 with the lower face 72 adjacent the flexible diaphragm 66. The upper end of the spring 70, which is stainless steel in the illustrated embodiment, is retained on a spike 82 formed in the chassis and the lower end of the spring 70 is retained on the spike 78 on the pressure plate 68. In this manner, the spring biases the pressure plate 68 downward against the diaphragm 66 to increase the volume of the chamber. The wall 74 and wings 80 serve to stabilize the orientation of the pressure plate 68 while allowing for its free, piston-like movement within the chamber 56.

Figure 7:
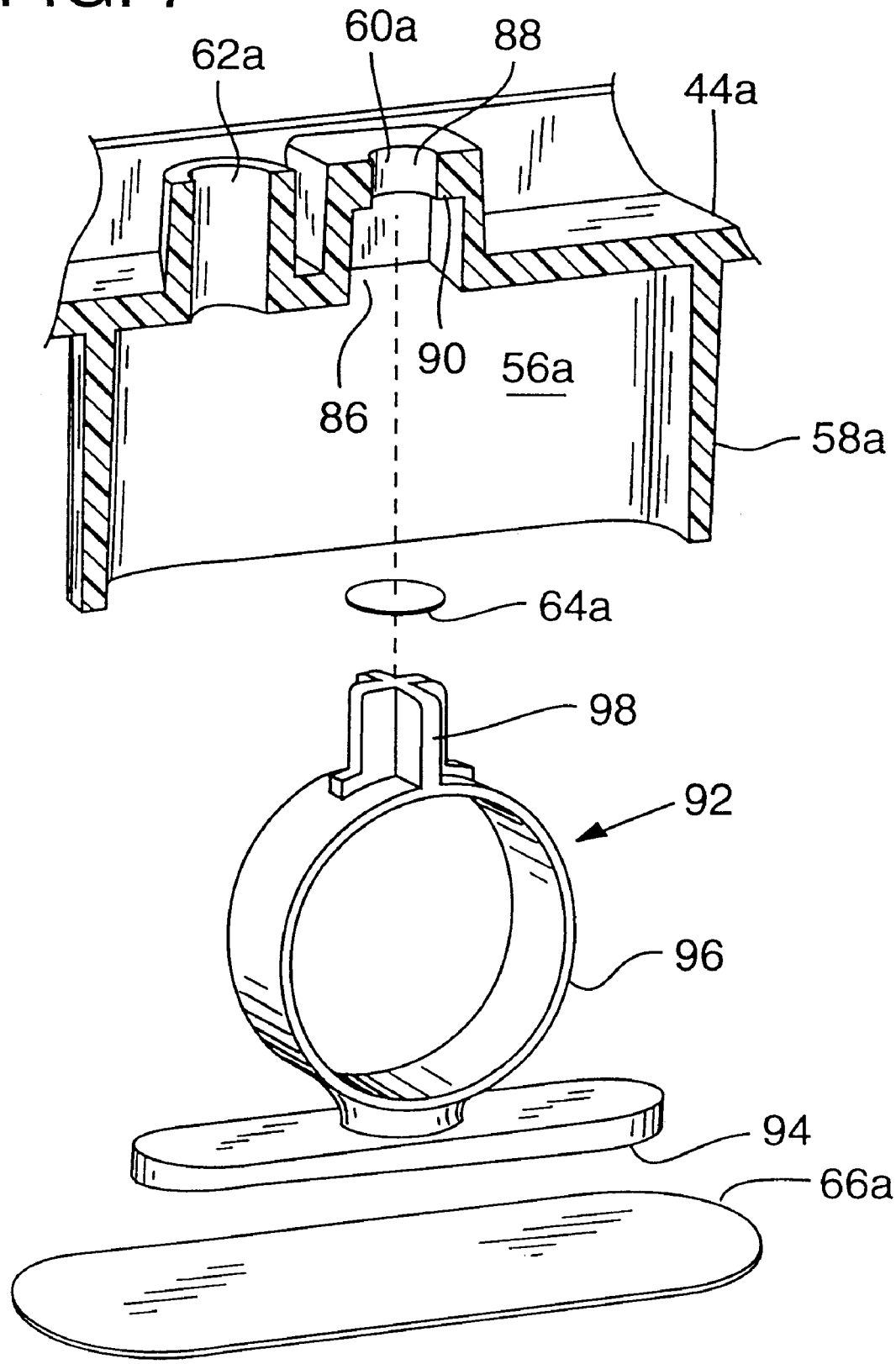
FIG. 7 is an exploded, cross sectional view of an alternative pump for use in an ink supply that can be refilled using the method of the present invention.

An alternative embodiment of the pump 26 is illustrated in FIG. 7. In this embodiment, the pump 26 includes a chamber 56*a* defined by a skirt-like wall 58*a* depending downwardly from the body 44*a* of the chassis. A flexible diaphragm 66*a* is attached to the lower edge of the wall 58*a* to enclose the lower end of the chamber 56*a*. A pump inlet 60*a* at the top of the chamber 56*a* extends from the chamber 56*a* into the ink reservoir 24*a*, and a pump outlet 62*a* allows ink to exit the chamber 56*a*. The pump inlet 60*a* has a wide portion 86 opening into the chamber 56*a*, a narrow portion 88 opening into the ink reservoir, and a shoulder 90 joining the wide portion 86 to the narrow portion 88. A valve 64*a* is positioned in the pump inlet 60*a* to allow the flow of ink into the chamber 56*a* and limit the flow of ink from the chamber 56 back into the ink reservoir 24*a*. In the illustrated embodiment, the valve is circular. However, other shaped valves, such as square or rectangular, could also be used.

In the embodiment of FIG. 7, a unitary spring/pressure plate 92 is positioned within the chamber 56*a*. The spring/pressure plate 92 includes a flat lower face 94 that is positioned adjacent the diaphragm 66*a*, a spring portion 96 that biases the lower face downward, and a mounting stem 98 that is friction fit into the wide portion 86 of the pump inlet 60*a*. In the illustrated embodiment, the spring portion 96 is generally circular in configuration and is pre-stressed into a flexed position by the diaphragm 66*a*. The natural resiliency of the material used to construct the spring/pressure plate 92 urges the spring to its original configuration, thereby biasing the lower face downward to expand the volume of the chamber 56*a*. The unitary spring/pressure plate 92 may be formed of various suitable materials such as, for example, HYTREL.

In this embodiment, the valve 64*a* is a flapper valve that is held in position on the shoulder 90 of the pump inlet 60*a* by the top of the mounting stem 98. The mounting stem 98 has a cross shape which allows the flapper valve 64*a* to deflect downward into four open quadrants to allow ink to flow from the ink reservoir 24*a* into the chamber. The shoulder prevents the flapper valve from deflecting in the upward direction to limit the flow of ink from the chamber back into the reservoir 24*a*. Rather, ink exits the chamber via the pump outlet 62. It should be appreciated that the mounting stem may have a "V" cross section, an "I" cross section, or any other cross section which allows the flapper valve to flex sufficiently to permit the needed flow of ink into the chamber.

As illustrated in FIG. 2, a conduit 84 joins the pump outlet 62 to the fluid outlet 28. In the illustrated embodiment, the top wall of the conduit 84 is formed by the lower member of the frame 46, the bottom wall is formed by the body 44 of the chassis 22; one side is enclosed by a portion of the chassis and the other side is enclosed by a portion of one of the plastic sheets 50.

As illustrated in FIGS. 1 and 2, the fluid outlet 28 is housed within a hollow cylindrical boss 99 that extends downward from the chassis 22. The top of the boss 99 opens into the conduit 84 to allow ink to flow from the conduit 84 into the fluid outlet 28. A spring 100 and sealing ball 102 are positioned within the boss 99 and are held in place by a compliant septum 104 and a crimp cover 106. The length of the spring 100 is such that it can be placed into the inverted boss 99 with the ball 102 on top. The septum 104 can then inserted be into the boss 99 to compress the spring 100 slightly so that the spring 100 biases the sealing ball 102 against the septum 104 to form a seal. The crimp cover 106 fits over the septum 104 and engages an annular projection 108 on the boss 99 to hold the entire assembly in place.

In the illustrated embodiment, both the spring 100 and the ball 102 are stainless steel. The sealing ball 102 is sized such that it can move freely within the boss 99 and allow the flow of ink around the ball 102 when it is not in the sealing position. The septum 104 is formed of polyisoprene rubber and has a concave bottom to receive a portion of the ball 102 to form a secure seal. The septum 104 is provided with a slit 110 (FIG. 1) so that it may be easily pierced without tearing or coring. However, the slit 110 is normally closed such that the septum 104 itself forms a second seal. The slit 110 may, preferably, be slightly tapered with its narrower end adjacent the ball 102. The illustrated crimp cover 106 is formed of aluminum and has a thickness of about 0.020 inches. A hole 112 is provided so that the crimp cover 106 does not interfere with the piercing of the septum 104.

With the pump and fluid outlet 28 in place, the ink reservoir 24 can be filled with ink. To fill the ink reservoir 24, ink can be injected through the fill port 52. As ink is being introduced into the reservoir 24, a needle (not shown) can be inserted through the slit 110 in the septum 104 to depress the sealing ball 102 and allow the escape of any air from within the reservoir 24. Alternatively, a partial vacuum can be applied through the needle. The partial vacuum at the fluid outlet 28 causes ink from the reservoir 24 to fill the chamber 56, the conduit 84, and the cylindrical boss 99 such that little, if any, air remains in contact with the ink. The partial vacuum applied to the fluid outlet 28 also speeds the filling process. Once the ink supply 20 is filled, the plug 54 is press fit into the fill port 52 to prevent the escape of ink or the entry of air.

Of course, there are a variety of other methods which might also be used to fill the present ink supply 20. In some instances, it may be desirable to flush the entire ink supply 20 with carbon dioxide prior to filling it with ink. In this way, any gas trapped within the ink supply 20 during the filling process will be carbon dioxide, not air. This may be preferable because carbon dioxide may dissolve in some inks while air may not. In general, it is preferable to remove as much gas from the ink supply 20 as possible so that bubbles and the like do not enter the print head or the trailing tube. To this end, it may also be preferable to use degassed ink to further avoid the creation or presence of bubbles in the ink supply 20.

Although the ink reservoir 24 provides an ideal way to contain ink, it may be easily punctured or ruptured and may allow some amount of water loss from the ink. Accordingly, to protect the reservoir 24 and to further limit water loss, the reservoir 24 is enclosed within a protective shell 30. The illustrated shell 30 is made of clarified polypropylene. A thickness of about one millimeter has been found to provide robust protection and to prevent unacceptable water loss from the ink. However, the material and thickness of the shell 30 may vary in other embodiments.

As illustrated in FIG. 1, the top of the shell 30 has contoured gripping surfaces 114 that are shaped and textured to allow a user to easily grip and manipulate the ink supply 20. A vertical rib 116 having a detente 118 formed near its lower end projects laterally from each side of the shell 30. The base of the shell 30 is open to allow insertion of the chassis 22. A stop 120 extends laterally outward from each side of wall 58 that defines the chamber 56. These stops 120 abut the lower edge of the shell 30 when the chassis 22 is inserted.

The protective cap 32 is fitted to the bottom of the shell 30 to maintain the chassis 22 in position. The cap 32 is provided with recesses 128 which receive the stops 120 on the chassis 22. In this manner, the stops 120 are firmly secured between the cap 32 and the shell 30 to maintain the chassis 22 in position. The cap 32 is also provided with an aperture 34 to allow access to the pump 26 and with an aperture 36 to allow access to the fluid outlet 28. The cap 32 obscures the fill port 52 to help prevent tampering with the ink supply 20.

One end of the cap 32 is provided with projecting keys 130 which can identify the type or "family" of ink contained within the ink supply 20. For example, if the ink supply 20 is filled with ink suited for use with a particular printer or class of printers, a cap having keys of a selected number and spacing (in the illustrated embodiment, three evenly spaced apart keys are shown) to indicate that ink family is used.

The other end of the cap 32 is provided with a keyway 131 that, depending upon its particular location, size or both, is indicative of a certain color of ink, such as cyan, magenta, etc. Accordingly, if the ink supply 20 is filled with a particular color of ink, a cap having keyway(s) indicative of that color may be used. The color of the cap may also be used to indicate the color of ink contained within the ink supply 20.

As a result of this structure, the chassis 22 and shell 30 can be manufactured and assembled without regard to the particular type of ink they will contain. Then, after the ink reservoir 24 is filled, a cap indicative of the particular family and color of ink used is attached to the shell 30. This allows for manufacturing economies because a supply of empty chassis and shell 30 can be stored in inventory. Then when there is a demand for a particular type of ink, that ink can be introduced into the ink supply 20 and an appropriate cap fixed to the ink supply 20. Thus, this scheme reduces the need to maintain high inventories of ink supplies containing every type of ink.

As illustrated, the bottom of the shell 30 is provided with two circumferential grooves 122 which engage two circumferential ribs 124 formed on the cap 32 to secure the cap 32 to the shell 30. Sonic welding or some other mechanism may also be desirable to more securely fix the cap 32 to the shell 30. In addition, a label can be adhered to both the cap 32 and the shell 30 to more firmly secure them together. Pressure sensitive adhesive may be used to adhere the label in a manner that prevents the label from being peeled off and inhibits tampering with the ink supply 20.

The attachment between the shell 30 and the cap 32 should, preferably, be snug enough to prevent accidental separation of the cap 32 from the shell 30 and to resist the flow of ink from the shell 30 should the ink reservoir 24 develop a leak. However, it is also desirable that the attachment allow the slow ingress of air into the shell 30 as ink is depleted from the reservoir 24 to maintain the pressure inside the shell 30 generally the same as the ambient pressure. Otherwise, a negative pressure may develop inside the shell 30 and inhibit the flow of ink from the reservoir 24. The ingress of air should be limited, however, in order to maintain a high humidity within the shell 30 and minimize water loss from the ink.

The illustrated shell 30, and the flexible reservoir 24 which it contains, have the capacity to hold approximately thirty cubic centimeters of ink. The shell 30 is approximately 67 millimeters wide, 15 millimeters thick, and 60 millimeters high. Of course, other dimensions and shapes can also be used depending on the particular needs of a given printer.

Figure 8:
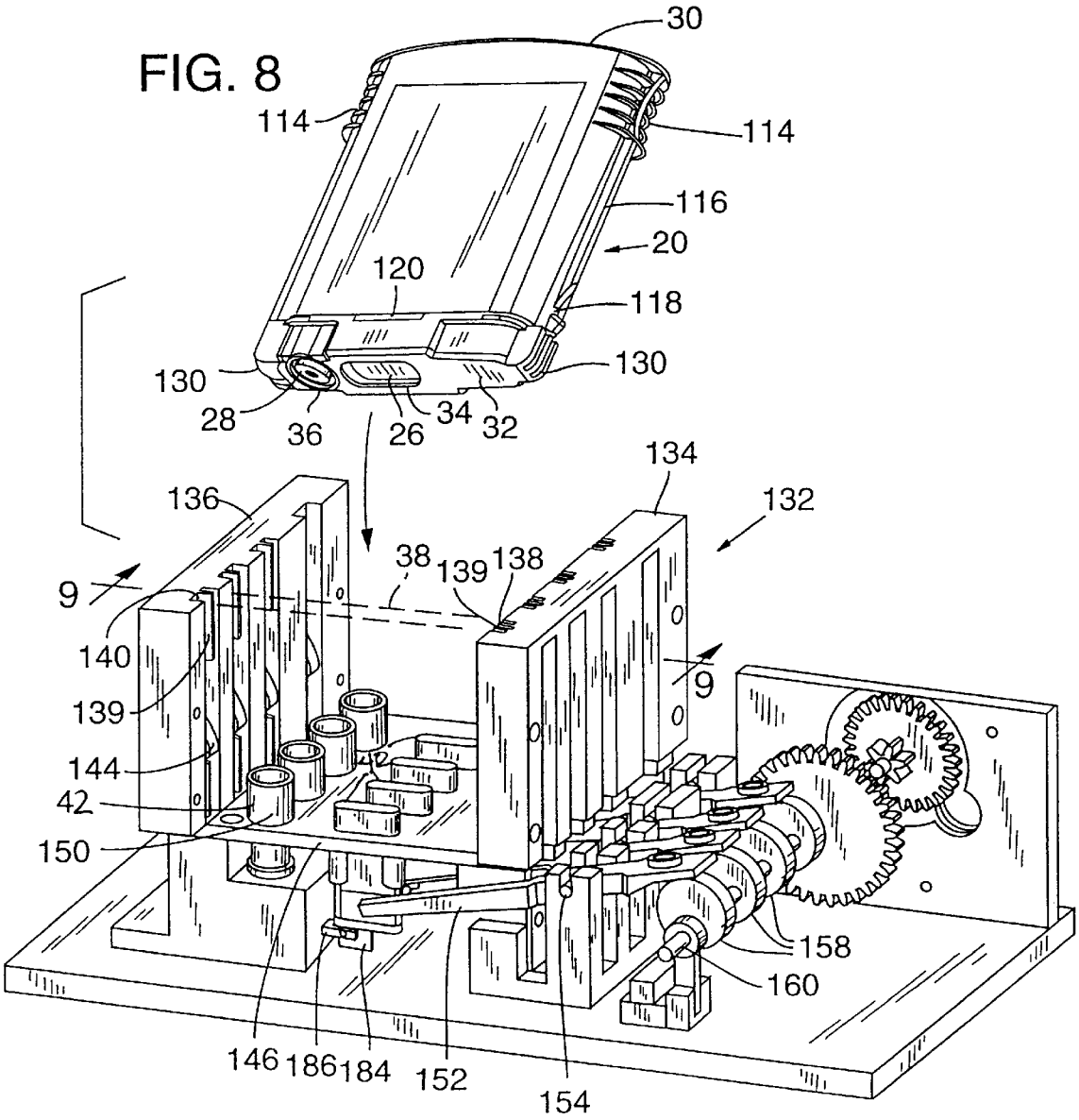
FIG. 8 shows the ink supply of FIG. 1 being inserted into a docking bay of an ink-jet printer.

The illustrated ink supply 20 is ideally suited for insertion into a docking station 132 like that illustrated in FIGS. 8–10. The docking station 132 illustrated in FIG. 8, is intended for use with a color printer. Accordingly, it has four side-by-side docking bays 38, each of which can receive one ink supply 20 of a different color. The structure of the illustrated ink supply 20 allows for the supply to be relatively narrow in width. This allows for four ink supplies to be arranged side-by-side in a compact docking station without unduly increasing the "footprint" of the printer.

Each docking bay 38 includes opposing walls 134 and 136 which define inwardly facing vertical channels 138 and 140. A leaf spring 142 having an engagement prong 144 is positioned within the lower portion of each channel 138 and 140. The engagement prong 144 of each leaf spring 142 extends into the channel toward the docking bay 38 and is biased inward by the leaf spring. One of the channels 138 is provided with keys 139 formed therein to mate with the keyway(s) 131 on one side of the ink supply cap 32. The other channel 140 is provided with keyways 141 to mate with the keys 130 on the other side of the cap 32.

A base plate 146 defines the bottom of each docking bay 38. The base plate 146 includes an aperture 148 which receives the actuator 40 and carries a housing 150 for the fluid inlet 42.

As illustrated in FIG. 8, the upper end of the actuator extends upward through the aperture 148 in the base plate 146 and into the docking bay 38. The lower portion of the actuator 40 is positioned below the base plate and is pivotably coupled to one end of a lever 152 which is supported on pivot point 154. The other end of the lever 154 is biased downward by a compression spring 156. In this manner, the force of the compression spring 156 urges the actuator 40 upward. A cam 158 mounted on a rotatable shaft 160 is positioned such that rotation of the shaft 160 to an engaged position causes the cam 158 to overcome the force of the compression spring 156 and move the actuator 40 downward. Movement of the actuator 40, as explained in more detail below, causes the pump 26 to draw ink from the reservoir 24 and supply it through the fluid outlet 28 and the fluid inlet 42 to the printer.

As seen in FIG. 9, the fluid inlet 42 is positioned within the housing 150 carried on the base plate 146. The illustrated fluid inlet 42 includes an upwardly extending needle 162 having a closed blunt upper end 164, a blind bore 166 and a lateral hole 168. A trailing tube (not shown) is connected to the lower end of the needle 162 such that the blind bore 166 is in fluid communication therewith. The trailing tube leads to a print head (not shown). In most printers, the print head will usually include a small ink well for maintaining a small quantity of ink and some type of pressure regulator to maintain an appropriate pressure within the ink well. Typically, it is desired that the pressure within the ink well be slightly less than ambient. This "back pressure" helps to prevent ink from dripping from the print head. The pressure regulator at the print head may commonly include a check valve which prevents the return flow of ink from the print head and into the trailing tube.

A sliding collar 170 surrounds the needle 162 and is biased upwardly by a spring 172. The sliding collar 170 has a compliant sealing portion 174 with an exposed upper surface 176 and an inner surface 178 in direct contact with the needle 162. In addition, the illustrated sliding collar includes a substantially rigid portion 180 extending downwardly to partially house the spring 172. An annular stop 182 extends outward from the lower edge of the substantially rigid portion 180. The annular stop 182 is positioned beneath the base plate 146 such that it abuts the base plate 146 to limit upward travel of the sliding collar 170 and define an upper position of the sliding collar 170 on the needle 162. In the upper position, the lateral hole 168 is surrounded by the sealing portion 174 of the collar 170 to seal the lateral hole 168 and the blunt end 164 of the needle 162 is generally even with the upper surface 176 of the collar 170.

In the illustrated configuration, the needle 162 is an eighteen gauge stainless steel needle with an inside diameter of about 1.04 millimeters, an outside diameter of about 1.2 millimeters, and a length of about 30 millimeters. The lateral hole 168 is generally rectangular with dimensions of about 0.55 millimeters by 0.70 millimeters and is located about 1.2 millimeters from the upper end of the needle 162. The sealing portion 174 of the sliding collar 170 is made of ethylene propylene dimer monomer and the generally rigid portion 176 is made of polypropylene or any other suitably rigid material. The sealing portion 174 is molded with an aperture to snugly receive the needle 162 and form a robust seal between the inner surface 178 and the needle 162. Alternative dimensions, materials or configurations might also be used.

To install an ink supply 20 within the docking bay 38, a user can simply place the lower end of the ink supply 20 between the opposing walls 134 and 136 with one edge in one vertical channel 138 and the other edge in the other vertical channel 140, as shown in FIGS. 8 and 9. The ink supply 20 is then pushed downward into the installed position, shown in FIG. 10, in which the bottom of the cap 32 abuts the base plate 146. As the ink supply 20 is pushed downward, the fluid outlet 28 and fluid inlet 42 automatically engage and open to form a path for fluid flow from the ink supply 20 to the printer, as explained in more detail below. In addition, the actuator 40 enters the aperture 34 in the cap 32 to pressurize the pump 26, as explained in more detail below.

Once in position, the engagement prongs 144 on each side of the docking station engage the detentes 118 formed in the shell 30 to firmly hold the ink supply 20 in place. The leaf springs 142, which allow the engagement prongs 144 to move outward during insertion of the ink supply 20, bias the engagement prongs 144 inward to positively hold the ink supply 20 in the installed position. Throughout the installation process and in the installed position, the edges of the ink supply 20 are captured within the vertical channels 138 and 140 which provide lateral support and stability to the ink supply 20. In some embodiments, it may be desirable to form grooves in one or both of the channels 138 and 140 which receive the vertical rib 116 formed in the shell 30 to provide additional stability to the ink supply 20.

To remove the ink supply 20, a user simply grasps the ink supply 20, using the contoured gripping surfaces 114, and pulls upward to overcome the force of the leaf springs 142. Upon removal, the fluid outlet 28 and fluid inlet 42 automatically disconnect and reseal leaving little, if any, residual ink and the pump 26 is depressurized to reduce the possibility of any leakage from the ink supply 20.

Operation of the fluid interconnect, which comprises the fluid outlet 28 and the fluid inlet 42, during insertion of the ink supply 20 is illustrated in FIGS. 9 and 10. FIG. 9 shows the fluid outlet 28 upon its initial contact with the fluid inlet 42. As illustrated in FIG. 9, the housing 150 has partially entered the cap 32 through aperture 36 and the lower end of the fluid outlet 28 has entered into the top of the housing 150. At this point, the crimp cover 106 contacts the sealing collar 170 to form a seal between the fluid outlet 28 and the fluid inlet 42 while both are still in their sealed positions. This seal acts as a safety barrier in the event that any ink should leak through the septum 104 or from the needle 162 during the coupling and decoupling process.

In the illustrated configuration, the bottom of the fluid inlet 42 and the top of the fluid outlet 28 are both generally planar. Thus, very little air is trapped within the seal between the fluid outlet 28 of the ink supply 20 and the fluid inlet 42 of the printer. This facilitates proper operation of the printer by reducing the possibility that air will enter the fluid outlet 28 or the fluid inlet 42 and reach the ink-jets in the print head.

As the ink supply 20 is inserted further into the docking bay 38, the bottom of the fluid outlet 28 pushes the sliding collar 170 downward, as illustrated in FIG. 10. Simultaneously, the needle 162 enters the slit 110 and passes through the septum 104 to depress the sealing ball 102. Thus, in the fully inserted position, ink can flow from the boss 99, around the sealing ball 102, into the lateral hole 168, down the bore 166, through the trailing tube 169 to the print head.

Upon removal of the ink supply 20, the needle 162 is withdrawn and the spring 100 presses the sealing ball 102 firmly against the septum 104 to establish a robust seal. In addition, the slit 110 closes to establish a second seal, both of which serve to prevent ink from leaking through the fluid outlet 28. At the same time, the spring 172 pushes the sliding collar 170 back to its upper position in which the lateral hole 168 is encased within the sealing portion of the collar 170 to prevent the escape of ink from the fluid inlet 42. Finally, the seal between the crimp cover 106 and the upper surface 176 of the sliding collar 170 is broken. With this fluid interconnect, little, if any, ink is exposed when the fluid outlet 28 is separated from the fluid inlet 42. This helps to keep both the user and the printer clean.

Although the illustrated fluid outlet 28 and fluid inlet 42 provide a secure seal with little entrapped air upon sealing and little excess ink upon unsealing, other fluid interconnections might also be used to connect the ink supply 20 to the printer.

Figure 11A:
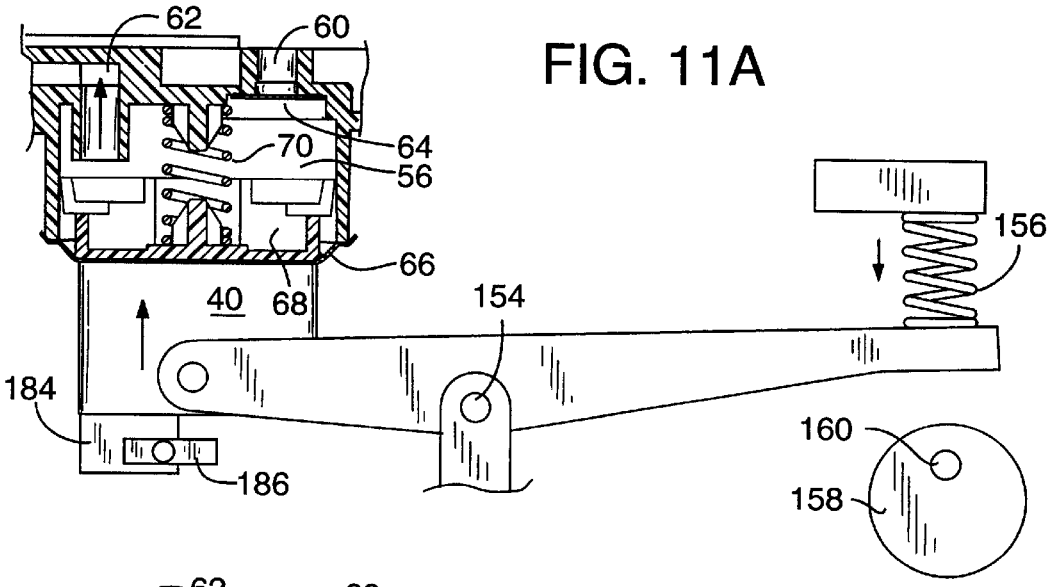

When the ink supply 20 is inserted into the docking bay 38, the actuator 40 enters through the aperture 34 in the cap 32 and into position to operate the pump 26. FIGS. 11A–D illustrate various stages of the pump's operation. FIG. 11A illustrates the fully charged position of the pump 26. The flexible diaphragm 66 is in its lowermost position, and the volume of the chamber 56 is at its maximum. The actuator 40 is pressed against the diaphragm 66 by the compression spring 156 to urge the chamber 56 to a reduced volume and create pressure within the pump chamber 56. With the pump chamber 56 pressurized, the valve 64 closes to prevent the flow of ink from the chamber 56 back into the reservoir 24, causing the ink to pass from the chamber 56 through the pump outlet 62 and the conduit 84 to the fluid outlet 28. In the illustrated configuration, the compression spring 156 is chosen so as to create a pressure of about 1.5 pounds per square inch within the chamber 56. Of course, the desired pressure may vary depending on the requirements of a particular printer and may vary through the pump stroke. For example, in the illustrated embodiment, the pressure within the chamber will vary from about 90–45 inches of water column during the pump stroke.

Figure 11B:
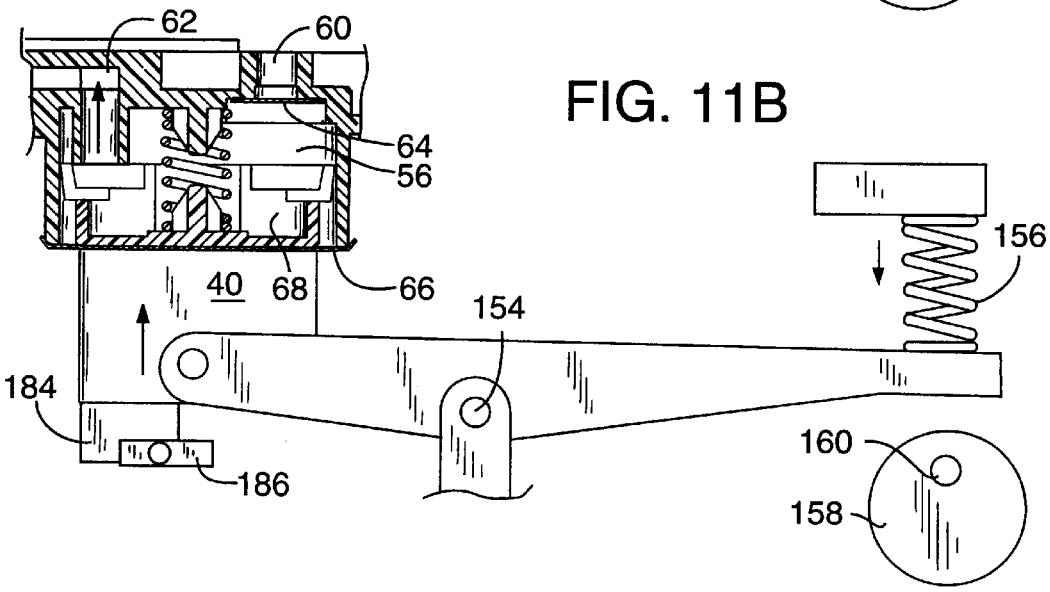

As ink is depleted from the pump chamber 56, the compression spring 156 continues to press the actuator 40 upward against the diaphragm 66 to maintain a pressure within the pump chamber 56. This causes the diaphragm 66 to move upward to an intermediate position decreasing the volume of the chamber 56, as illustrated in FIG. 11B.

Figure 11C:
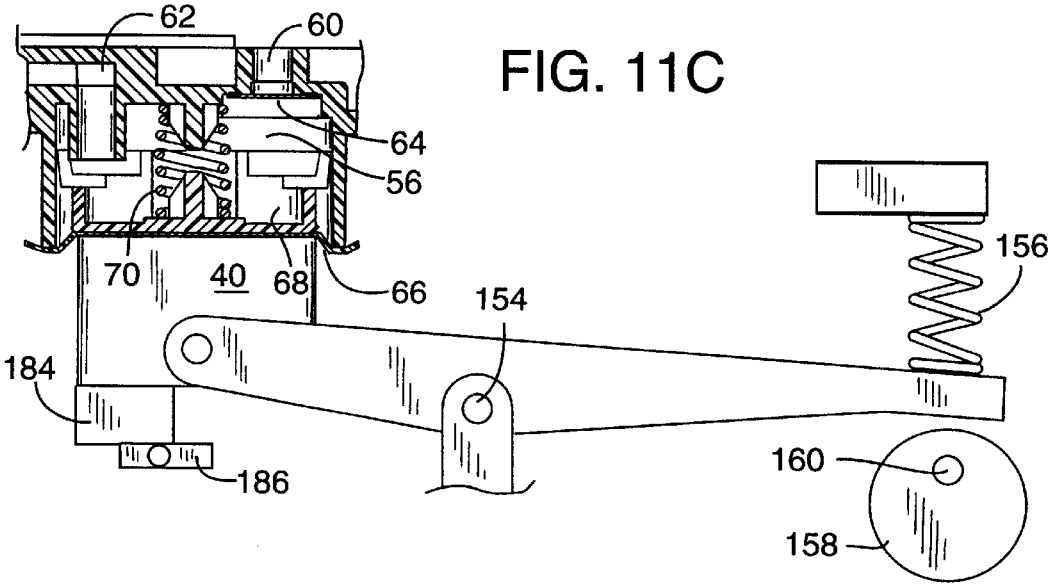

As still more ink is depleted from the pump chamber 56, the diaphragm 66 is pressed to its uppermost position, illustrated in FIG. 11C. In the uppermost position, the volume of the chamber 56 is at its minimum operational volume.

As illustrated in FIG. 11D, during the refresh cycle the cam 158 is rotated into contact with the lever 152 to compress the compression spring 156 and move the actuator 40 to its lowermost position. In this position, the actuator 40 does not contact the diaphragm 66.

With the actuator 40 no longer pressing against the diaphragm 66, the pump spring 70 biases the pressure plate 68 and diaphragm 66 outward, expanding the volume and decreasing the pressure within the chamber 56. With decreased pressure within the chamber 56, the valve 64 is open and ink is drawn from the reservoir 24 into the chamber 56 to refresh the pump 26, as illustrated in FIG. 11D. The check valve at the print head, the flow resistance within the trailing tube, or both, will limit ink from returning to the chamber 56 through the conduit 84. Alternatively, a check valve may be provided at the outlet port, or at some other location, to prevent the return of ink through the outlet port and into the chamber 56.

After a predetermined amount of time has elapsed, the refresh cycle is concluded by rotating the cam 158 back into its disengaged position and the ink supply 20 typically returns to the configuration illustrated in FIG. 11A.

The configuration of the ink supply 20 is particularly advantageous because only the relatively small amount of ink within the chamber 56 is pressurized when the actuator is engaged with the diaphragm 66. The large majority of the ink is maintained within the reservoir 24 at approximately ambient pressure. Thus, it is less likely to leak and, in the event of a leak, can be more easily contained.

The illustrated diaphragm pump has proven to be very reliable and well suited for use in the ink supply 20. However, other types of pumps may also be used. For example, a piston pump, a bellows pump, or other types of pumps might be adapted for use with the present invention.

In accordance with the method of the present invention, the ink supply 20 having a valve 64, a chamber 56 and a fluid outlet 28, as just described, is refilled once depleted.

The ink supply 20 is removed from the docking bay 38 for refilling. When the ink supply 20 is removed, the diaphragm 66 is no longer in contact with the actuator 40, which allows the chamber 56 to expand to its maximum volume and removes the chamber pressure applied by the actuator 40. With such pressure removed, the unattached sides of the valve 64 are free to bend downward, slightly opening the valve 64 (see FIG. 13). The bend in the valve 64 that occurs in the absence of pressure (other than the static ink pressure) in the chamber 56 is attributable to the slight deformation of the valve 64 that results as ink is normally pumped through the valve 64 into the chamber 56, forcing the valve 64 into an open, bent configuration. In short, the valve 64, under static conditions (i.e., the actuator in the disengaged position), assumes a slightly open position. With the valve 64 so positioned, a gradual, low-pressure flow of refill ink may be directed through the valve 64 into the reservoir 24, as depicted in FIG. 13 and explained more fully below.

Figure 12:
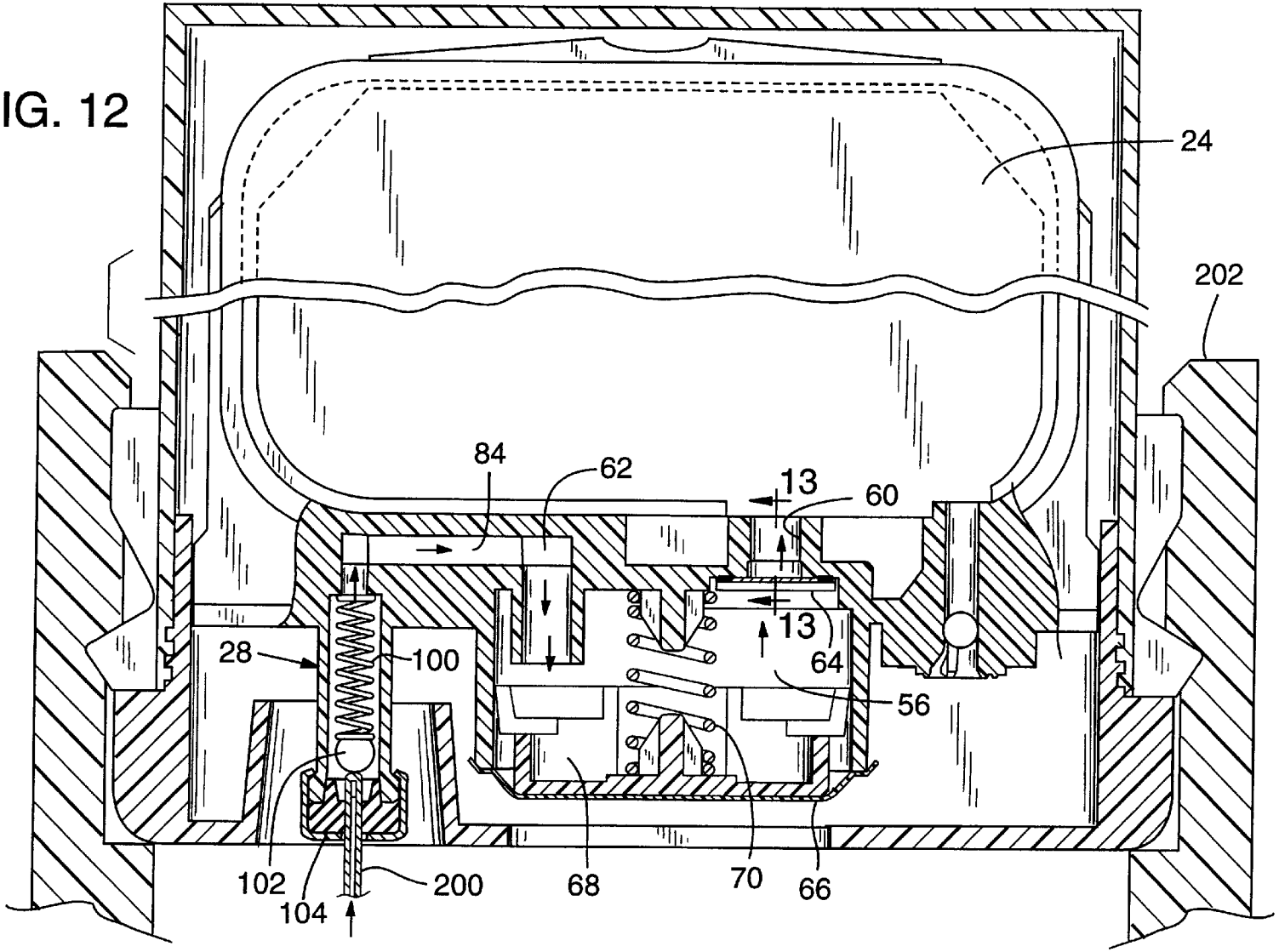
FIG. 12 illustrates the method of refilling of the present invention.

The ink supply 20 to be refilled may be placed in a stabilizing base 202, as shown in FIG. 12, or held steady by hand. The pump is permitted to assume the fully charged position, so that chamber 56 is essentially unpressurized. As illustrated in FIG. 12, a refill needle 200 is inserted into the slit in the septum 104 of the fluid outlet 28. The refill needle 200 is configured as the previously described needle 162 of the fluid inlet 42. Other configurations for a refill needle could be used. The needle 200 emanates from a source of refill ink that provides ink having the appropriate physical and chemical characteristics of the originally supplied ink.

Insertion of the refill needle 200 depresses the sealing ball 102 and the spring 100, thereby opening a path for ink flow through the fluid outlet 28, conduit 84, into the chamber 56. As previously stated, the valve 64 is slightly open and, thus, a complete path is available for flow of refill ink from the fluid outlet 28, through conduit 84, into chamber 56, through inlet 60, and into the reservoir 24 as shown by the arrows in FIG. 12.

The rate at which the refill ink is supplied is selected to be sufficiently slow, so that the valve 64 remains open during the entire refill process. In this regard, the refill flow from an ink refill container (not shown) may be induced by gravity, with the refill container elevated by an amount sufficient to create a pressure head to refill the reservoir 24 without forcing the valve 64 closed.

The method of the present invention is also useful for refilling an ink supply having a valve that is heat staked to the chassis 22 at a location other than the midpoints of its short sides. In particular, the present method could be used on a valve 64*b* that is heat staked to the chassis 22 on only one side, as shown in FIG. 14. In this case, the valve 64*b* would be likely to remain in a slightly deformed, open state that creates a relatively larger gap to allow refill ink flow into the reservoir 24.

Additionally, the method of the present invention could be used for refilling an ink supply having a unitary spring/pressure plate 92 as shown in FIG. 7 and described previously.

This detailed description is set forth only for purposes of illustrating examples of the present invention and should not be considered to limit the scope thereof in any way. Clearly, numerous additions, substitutions, and other modifications can be made to the invention without departing from the scope of the invention which is defined in the appended claims and equivalents thereof.

What is claimed is:

1. A refillable ink supply used to supply ink to a print head comprising:

a reservoir for containing refilled ink;

a pressurizable chamber connected to the reservoir;

a valve between the reservoir and the chamber, the valve closing when the chamber is pressurized to a positive pressure and opening when the chamber is not pressurized, thereby to permit the flow of refill ink from the chamber through the valve to the reservoir;

an outlet from the chamber; and wherein the outlet is a dual purpose apparatus comprising means for supplying ink from the reservoir and through the pressurizable chamber to the print head in one mode of operation and comprising means for directing ink from an ink supply through the pressurizable chamber to refill the reservoir in a second mode of operation.

2. The refillable ink supply of claim 1 in which the valve is made of a deformable material.

3. The refillable ink supply of claim 1 in which the reservoir, chamber, and valve are arranged such that the valve is not closed by the flow of refill ink therethrough at a rate sufficient to refill.

4. A method of refilling an ink supply used to supply ink to a print head, wherein the ink supply has a reservoir for containing ink, an openable and closable valve on the reservoir, a pressurizable chamber into which the valve opens, and wherein the chamber is pressurizable to a positive pressure to close the valve to prevent ink from flowing from the reservoir, and wherein there is an outlet from the chamber, the method comprising the steps of:

establishing a fluid connection between a source of ink and the outlet from the chamber;

directing ink from the ink source through the outlet to the reservoir while the valve is opened; and wherein prior to the step of directing ink from the outlet to the reservoir, the method includes providing ink from the reservoir to the pressurizable chamber.

5. The method of refilling an ink supply of claim 4 wherein after providing ink from the reservoir to the pressurizable chamber the method includes pressurizing the pressurizable chamber to close the valve producing ink flow from the ink container outlet.

6. A method of refilling an ink supply used to supply ink to a print head, wherein the ink supply has a reservoir for containing ink, an openable and closable valve on the reservoir, a pressurizable chamber into which the valve opens, and wherein the chamber is pressurizable to a positive pressure to close the valve to prevent ink from flowing from the reservoir, and wherein there is an outlet from the chamber, the method comprising the steps of:

directing ink from the reservoir through the pressurizable chamber and through the outlet to thereby supply ink to the print head; and thereafter, refilling the ink supply to replace ink which has flowed from the reservoir to the print head by directing ink from the outlet to the reservoir while the valve is opened.

* * * * *